US010304377B2

(12) United States Patent
Chen et al.

(10) Patent No.: US 10,304,377 B2
(45) Date of Patent: May 28, 2019

(54) DRIVING CIRCUIT FOR AMOLED DISPLAY PANEL AND AMOLED DISPLAY PANEL

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Xiaolong Chen, Shenzhen (CN); Yi-Chien Wen, Shenzhen (CN); Ming-Jong Jou, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/574,930

(22) PCT Filed: Oct. 17, 2017

(86) PCT No.: PCT/CN2017/106542
§ 371 (c)(1),
(2) Date: Nov. 17, 2017

(87) PCT Pub. No.: WO2019/024252
PCT Pub. Date: Feb. 7, 2019

(65) Prior Publication Data

US 2019/0043419 A1 Feb. 7, 2019

(30) Foreign Application Priority Data

Aug. 2, 2017 (CN) ..... 2017 1 0650425

(51) Int. Cl.
*G09G 3/3225* (2016.01)

(52) U.S. Cl.
CPC ... *G09G 3/3225* (2013.01); *G09G 2300/0426* (2013.01); *G09G 2310/0237* (2013.01)

(58) Field of Classification Search
USPC ..... 345/78, 82
See application file for complete search history.

(56) References Cited

U.S. PATENT DOCUMENTS

| | | | | |
|---|---|---|---|---|
| 6,229,506 | B1 * | 5/2001 | Dawson | G09G 3/3233 345/82 |
| 2008/0143653 | A1 * | 6/2008 | Shishido | G09G 3/3233 345/78 |
| 2016/0307502 | A1 * | 10/2016 | Nie | G09G 3/3233 |

FOREIGN PATENT DOCUMENTS

| | | | |
|---|---|---|---|
| CN | 101206832 | A | 6/2008 |
| CN | 104658483 | A | 5/2015 |
| CN | 105489165 | A | 4/2016 |
| CN | 106960659 | A | 7/2017 |

* cited by examiner

*Primary Examiner* — Tony O Davis
(74) *Attorney, Agent, or Firm* — Hauptman Ham, LLP

(57) ABSTRACT

A driving circuit for an active-matrix organic light-emitting diode (AMOLED) display panel includes a first thin-film transistor (TFT), a second TFT, a third TFT, a fourth TFT, a fifth TFT, a storage capacitor, and an organic light-emitting diode (OLED). The present disclosure also proposes an AMOLED display panel. The AMOLED display panel enhances uniformity of the display brightness of the AMOLED display panel.

10 Claims, 3 Drawing Sheets

DRIVING CIRCUIT FOR AMOLED DISPLAY PANEL AND AMOLED DISPLAY PANEL

BACKGROUND

1. Field of the Disclosure

The present disclosure relates to the field of a display technique, and more particularly, to a driving circuit for an active-matrix organic light-emitting diode (AMOLED) display panel and an AMOLED display panel with the driving circuit.

2. Description of the Related Art

Please refer to FIG. 1 illustrating a circuit diagram of a pixel driving circuit of an active-matrix organic light-emitting diode (AMOLED) display panel of the related art. The pixel driving circuit includes a first thin-film transistor (TFT) T11, a second thin-film transistor (TFT) T12, a storage capacitor C11, and an organic light-emitting diode (OLED) D11.

A scanning signal SCAN is received by a gate of the first TFT T11. A data signal DATA is received by a source of the first TFT T11. A drain of the first TFT T11 is electrically connected to one terminal of the storage capacitor C11. A gate of the second TFT T12 is electrically connected to the terminal of the storage capacitor C11. A source of the second TFT T12 is electrically connected to a driving voltage Ovdd. A drain of the second TFT T12 is electrically connected to an anode of the OLED D11. The other terminal of the storage capacitor C11 is electrically connected to the source of the second TFT T12. A cathode of the OLED D11 is electrically connected to a driving voltage Ovss. In this way, the luminance of the OLED D11 is well controlled with the data signal DATA.

The threshold voltage of the second TFT T12 of each of the pixel circuits may be different due to some reasons like unstable manufacturing process of the AMOLED display panel. Even if the same data signal is applied to the second TFT T12, the luminance of the OLED D11 may be inconsistent.

Therefore, it is necessary to provide a driving circuit for an AMOLED display panel and an AMOLED display panel with the driving circuit to solve the problem of the related art.

SUMMARY

An object of the present disclosure is to propose a driving circuit for an active-matrix organic light-emitting diode (AMOLED) display panel and the AMOLED display panel to improve uniformity of display brightness of the AMOLED display panel to solve the problem of the AMOLED display panel of the related art that the AMOLED display panel has poorer uniformity of display brightness due to inconsistency of the threshold voltage of first thin-film transistors (TFTs).

According to a first aspect of the present disclosure, a driving circuit for an active-matrix organic light-emitting diode (AMOLED) display panel includes: a first thin-film transistor (TFT), comprising a source connected to a corresponding data line, a drain connected to a first reference node, and a gate inputting a first controlling signal; a storage capacitor, comprising a first terminal and a second terminal; the second terminal grounded; a second TFT, comprising a source connected to the first reference node, a gate connected to a first terminal of the storage capacitor, and a drain connected to a second reference node; a third TFT, comprising a source connected to the second reference node, a gate inputting a third controlling signal, and a drain connected to a first terminal of the storage capacitor; a fourth TFT, comprising a source connected to the second reference node, a drain connected to a second driving voltage, and a gate connected to a fourth controlling signal; a fifth TFT, comprising a drain connected to the first reference node, and a gate inputting a fifth controlling signal; and an organic light-emitting diode (OLED), comprising a positive electrode connected to a first driving voltage and a negative electrode connected to a source of the fifth TFT. A time period of driving the AMOLED display panel by using the driving circuit comprises an electric-potential-initialization stage, a charge-storage stage, and an illumination-display stage. When the driving circuit of the AMOLED display panel keeps at the electric-potential-initialization stage, the first TFT and the fifth TFT are turned off; the third TFT and the fourth TFT are turned on; the storage capacitor is charged through the third TFT and the fourth TFT; the OLED does not emit light. When the driving circuit of the AMOLED display panel keeps at the charge-storage stage, the fourth TFT and the fifth TFT are turned off; the first TFT and the third TFT are turned on; the storage capacitor is charged by the first TFT, the second TFT, and the third TFT through the data line; the OLED does not emit light. When the driving circuit of the AMOLED display panel keeps at the illumination-display stage, the first TFT and the third TFT are turned off; the fourth TFT and the fifth TFT are turned on; luminance of the OLED is controlled by the storage capacitor through the first TFT.

According to another embodiment of the present disclosure, voltage across the charged storage capacitor is Vdata–Vth, where Vdata indicates data signal voltage of the data line, and Vth indicates threshold voltage of the second TFT.

According to a second aspect of the present disclosure, a driving circuit for an active-matrix organic light-emitting diode (AMOLED) display panel includes: a first thin-film transistor (TFT), comprising a source connected to a corresponding data line, a drain connected to a first reference node, and a gate inputting a first controlling signal; a storage capacitor, comprising a first terminal and a second terminal; the second terminal grounded; a second TFT, comprising a source connected to the first reference node, a gate connected to a first terminal of the storage capacitor, and a drain connected to a second reference node; a third TFT, comprising a source connected to the second reference node, a gate inputting a third controlling signal, and a drain connected to a first terminal of the storage capacitor; a fourth TFT, comprising a source connected to the second reference node, a drain connected to a second driving voltage, and a gate connected to a fourth controlling signal; a fifth TFT, comprising a drain connected to the first reference node, and a gate inputting a fifth controlling signal; and an organic light-emitting diode (OLED), comprising a positive electrode connected to a first driving voltage and a negative electrode connected to a source of the fifth TFT.

According to another embodiment of the present disclosure, a time period of driving the AMOLED display panel by using the driving circuit comprises an electric-potential-initialization stage, a charge-storage stage, and an illumination-display stage.

According to another embodiment of the present disclosure, when the driving circuit of the AMOLED display panel keeps at the electric-potential-initialization stage, the first TFT and the fifth TFT are turned off; the third TFT and the fourth TFT are turned on; the storage capacitor is charged through the third TFT and the fourth TFT; the OLED does not emit light.

According to another embodiment of the present disclosure, when the driving circuit of the AMOLED display panel keeps at the charge-storage stage, the fourth TFT and the fifth TFT are turned off; the first TFT and the third TFT are turned on; the storage capacitor is charged by the first TFT, the second TFT, and the third TFT through the data line; the OLED does not emit light.

According to another embodiment of the present disclosure, voltage across the charged storage capacitor is Vdata–Vth, where Vdata indicates data signal voltage of the data line, and Vth indicates threshold voltage of the second TFT.

According to another embodiment of the present disclosure, when the driving circuit of the AMOLED display panel keeps at the illumination-display stage, the first TFT and the third TFT are turned off; the fourth TFT and the fifth TFT are turned on; luminance of the OLED is controlled by the storage capacitor through the first TFT.

According to a second aspect of the present disclosure, an active-matrix organic light-emitting diode (AMOLED) display panel includes a plurality of pixel units and a driving circuit. The driving circuit includes: a first thin-film transistor (TFT), comprising a source connected to a corresponding data line, a drain connected to a first reference node, and a gate inputting a first controlling signal; a storage capacitor, comprising a first terminal and a second terminal; the second terminal grounded; a second TFT, comprising a source connected to the first reference node, a gate connected to a first terminal of the storage capacitor, and a drain connected to a second reference node; a third TFT, comprising a source connected to the second reference node, a gate inputting a third controlling signal, and a drain connected to a first terminal of the storage capacitor; a fourth TFT, comprising a source connected to the second reference node, a drain connected to a second driving voltage, and a gate connected to a fourth controlling signal; a fifth TFT, comprising a drain connected to the first reference node, and a gate inputting a fifth controlling signal; and an organic light-emitting diode (OLED), comprising a positive electrode connected to a first driving voltage and a negative electrode connected to a source of the fifth TFT.

According to another embodiment of the present disclosure, a time period of driving the AMOLED display panel by using the driving circuit comprises an electric-potential-initialization stage, a charge-storage stage, and an illumination-display stage.

According to another embodiment of the present disclosure, when the driving circuit of the AMOLED display panel keeps at the electric-potential-initialization stage, the first TFT and the fifth TFT are turned off; the third TFT and the fourth TFT are turned on; the storage capacitor is charged through the third TFT and the fourth TFT; the OLED does not emit light.

According to another embodiment of the present disclosure, when the driving circuit of the AMOLED display panel keeps at the charge-storage stage, the fourth TFT and the fifth TFT are turned off; the first TFT and the third TFT are turned on; the storage capacitor is charged by the first TFT, the second TFT, and the third TFT through the data line; the OLED does not emit light.

According to another embodiment of the present disclosure, voltage across the charged storage capacitor is Vdata–Vth, where Vdata indicates data signal voltage of the data line, and Vth indicates threshold voltage of the second TFT.

According to another embodiment of the present disclosure, when the driving circuit of the AMOLED display panel keeps at the illumination-display stage, the first TFT and the third TFT are turned off; the fourth TFT and the fifth TFT are turned on; luminance of the OLED is controlled by the storage capacitor through the first TFT.

Owing to the arrangement of five TFTs and one storage capacitor for the driving circuit of the AMOLED display panel and the AMOLED display panel proposed by the present disclosure, the luminance of the OLED is not affected by the threshold voltage of the TFT, thereby enhancing uniformity of the display brightness of the AMOLED display panel. In this way, the AMOLED display panel with poorer uniformity of display brightness due to inconsistency of the threshold voltage of the TFT in the related art is well solved.

BRIEF DESCRIPTION OF THE DRAWINGS

The invention is described below in detail with reference to the accompanying drawings, wherein like reference numerals are used to identify like elements illustrated in one or more of the figures thereof, and in which exemplary embodiments of the invention are shown.

DETAILED DESCRIPTION OF THE EMBODIMENTS

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

Figure 1:
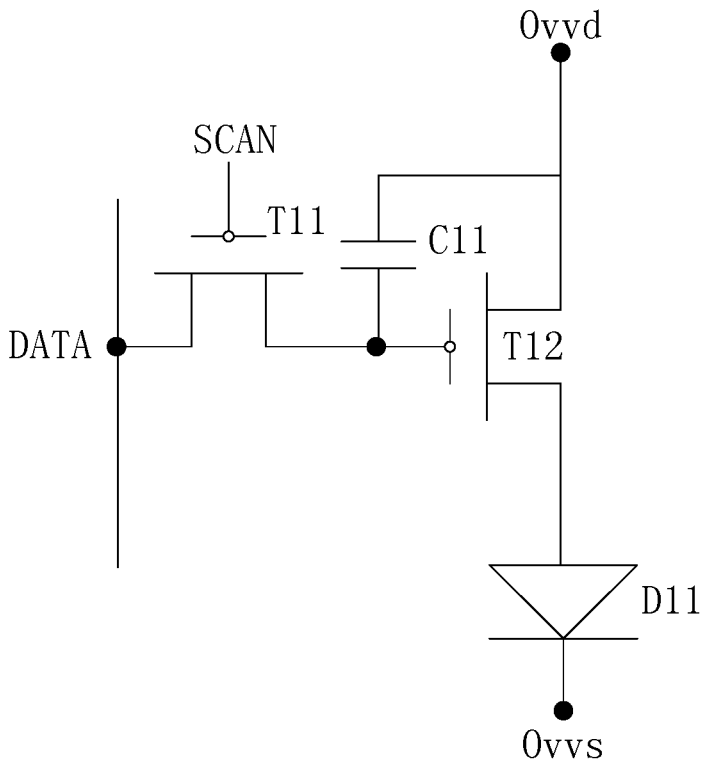
Fig. 1 (Related art)
FIG. 1 illustrating a circuit diagram of a pixel driving circuit of an active-matrix organic light-emitting diode (AMOLED) display panel of the related art.
Figure 2:
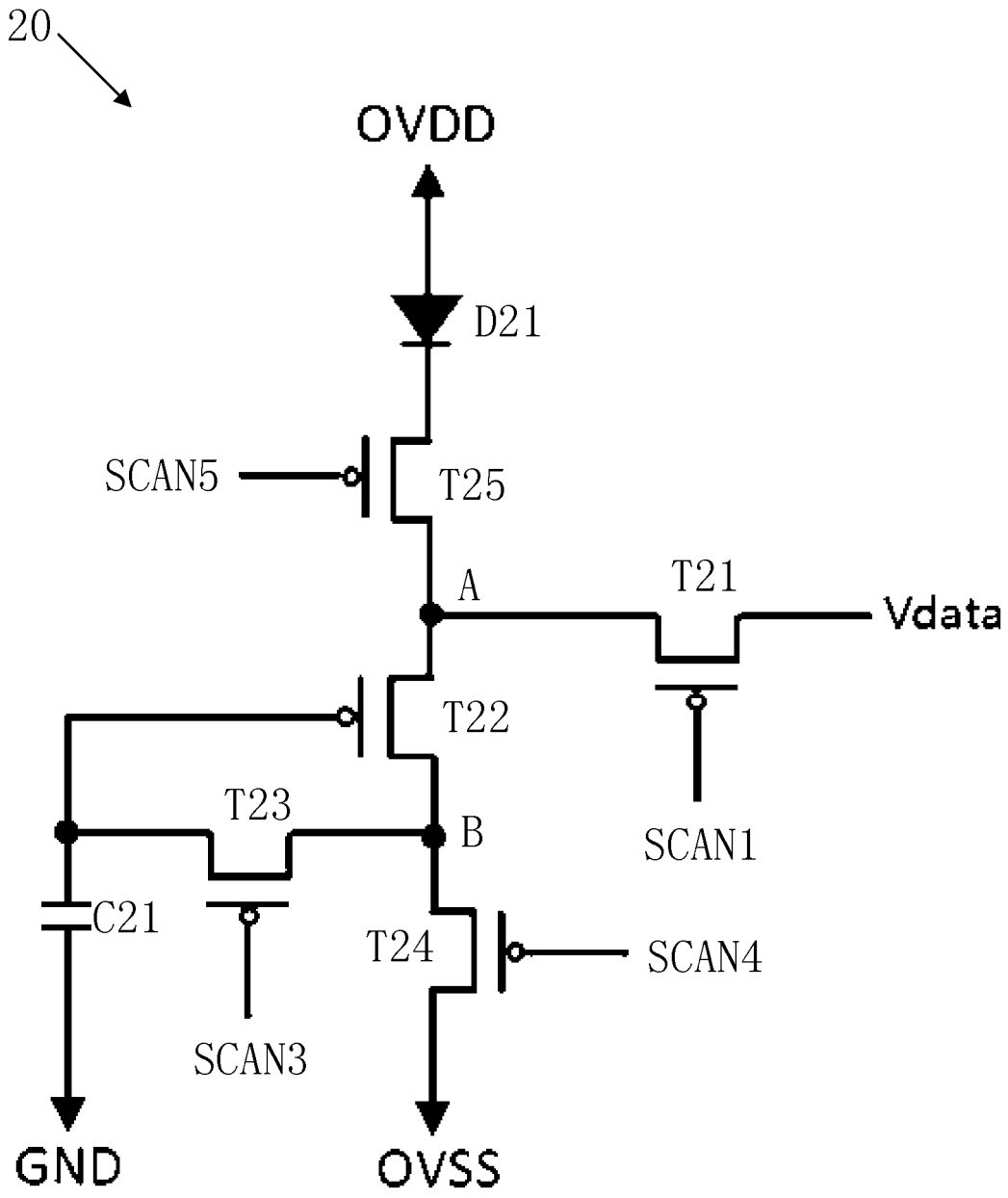
FIG. 2 is a circuit diagram of a driving circuit used in an active-matrix organic light-emitting diode (AMOLED) display panel according to an embodiment of the present disclosure.

FIG. 2 is a circuit diagram of a driving circuit 20 used in an active-matrix organic light-emitting diode (AMOLED) display panel 20 according to an embodiment of the present disclosure. The driving circuit 20 for driving the AMOLED display panel includes a first thin-film transistor (TFT) T21, a second TFT T22, a third TFT T23, a storage capacitor C21, a fourth TFT T24, a fifth TFT T25, and an organic light-emitting diode (OLED) D21.

A source of the first TFT T21 is connected to a corresponding data line. A drain of the first TFT T21 is connected to a first reference node A. A gate of the first TFT T21 is connected to a first controlling signal SCAN1. A source of the second TFT T22 is connected to the first reference node A. A gate of the second TFT T22 is connected to one terminal of the storage capacitor C21. A drain of the second TFT T22 is connected to a second reference node B. A source of the third TFT T23 is connected to the second reference node B. A gate of the third TFT T23 is connected to a third controlling signal SCAN3. A drain of the third TFT T23 is connected to the one terminal of the storage capacitor C21. Another terminal of the storage capacitor C21 is grounded. A source of the fourth TFT T24 is connected to the second reference node B. A drain of the fourth TFT T24 is connected to a second driving voltage OVSS. A gate of the fourth TFT T24 is connected to a fourth controlling signal SCAN4. A drain of the fifth TFT T25 is connected to the first reference node A. A source of the fifth TFT T25 is connected to a negative electrode of the OLED D21. A gate of the fifth TFT T25 is connected to a fifth controlling signal SCAN5. A positive electrode of the OLED D21 is connected to a first driving voltage OVDD.

The driving circuit for the AMOLED display panel proposed by the embodiment of the present disclosure includes operating stages such as an electric-potential-initialization stage, a charge-storage stage, and an illumination-display stage.

Figure 3:
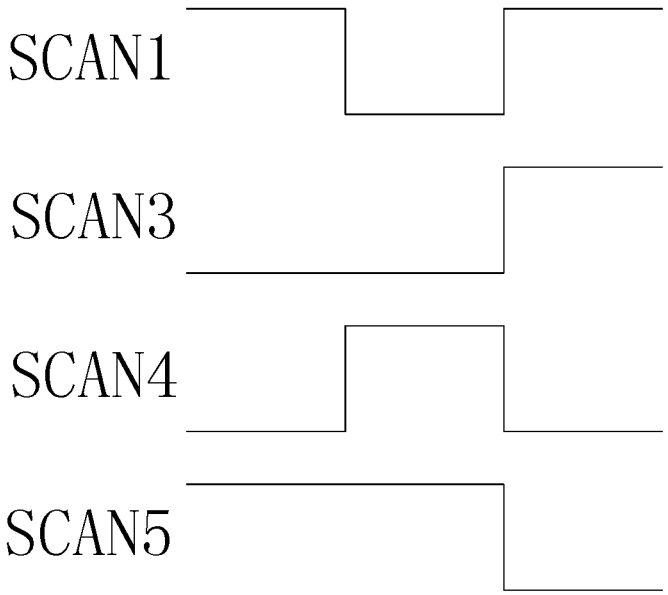
FIG. 3 illustrates waveforms applied in the driving circuit shown in FIG. 2 according to an embodiment of the present disclosure.

The operation principle of the driving circuit for the AMOLED display panel is elaborated in FIG. 2 and FIG. 3 in the present disclosure.

When an image needs to be displayed with one pixel circuit of the AMOLED display panel, the driving circuit 20, which the pixel circuit corresponds to, keeps at the electric-potential-initialization stage at first. Meanwhile, the first controlling signal SCAN1 is a high-voltage-level signal; the third controlling signal SCAN3 is a low-voltage-level signal; the fourth controlling signal SCAN4 is a low-voltage-level signal; the fifth controlling signal SCAN5 is a high-voltage-level signal. Accordingly, the first TFT T21 and the fifth TFT T25 are turned off. The third TFT T23 and the fourth TFT T24 are turned on. The storage capacitor C21 charges the third TFT T23 and the fourth TFT T24 to make the voltage applied on the one terminal of the storage capacitor C21 be OVSS and the other terminal of the storage capacitor C21 be GND; that is, each of the two terminals of the storage capacitor C21 is ground voltage. In this way, the storage capacitor C21 is initialized, and the OLED D21 does not emit light at this time.

Afterwards, the driving circuit 20, which the pixel circuit corresponds to, keeps at the charge-storage stage. At this time, the first controlling signal SCAN1 is a low-voltage-level signal; the third controlling signal SCAN3 is a low-voltage-level signal; the fourth controlling signal SCAN4 is a high-voltage-level signal; the fifth controlling signal SCAN5 is a high-voltage-level signal. Accordingly, the fourth TFT T24 and the fifth TFT T25 are turned off, and the first TFT T21 and the third TFT T23 are turned on. The storage capacitor C21 is charged by the first TFT T21, the second TFT T22, and the third TFT T23 through the data line. The source voltage of the second TFT T22 is Vdata. When the second TFT T22 is turned off, the gate voltage of the second TFT T22 is Vdata−Vth where Vth indicates the threshold voltage of the second TFT T22; that is, the voltage across the charged storage capacitor C21 is Vdata−Vth. In this way, the storage capacitor C21 is completely charged through the data line while the OLED D21 does not emit light.

Finally, the driving circuit 20, which the pixel circuit corresponds to, keeps at the illumination-display stage. At this time, the first controlling signal SCAN1 is a high-voltage-level signal; the third controlling signal SCAN3 is a high-voltage-level signal; the fourth controlling signal SCAN4 is a low-voltage-level signal; the fifth controlling signal SCAN5 is a low-voltage-level signal. Accordingly, the first TFT T21 and the third TFT T23 are turned off, and the fourth TFT T24 and the fifth TFT T25 are turned on.

At this time, the electric potential of the first reference node A is Vs=OVDD−Voled where Voled indicates turn-on voltage of the OLED D21. The dropout voltage between the voltage applied on the source of the second TFT T22 and the voltage applied on the gate of the second TFT T22 is Vsg=Vs−Vg=OVDD−Voled−(Vdata−Vth)=OVDD−Voled−Vdata+Vth where Vs indicates source voltage of the second TFT T22, and Vg indicates gate voltage of the second TFT T22.

A driving current of the second TFT T22 is $I=k(Vsg-Vth)^2=k(OVDD-Voled-Vdata)^2$ based on the TFT IV curve equation, and k is a constant. The driving current is irrelevant to the threshold voltage of the second TFT T22 so the influence of the threshold voltage on the driving current greatly decreases, thereby avoiding inconsistency of the luminance of the OLED D21 and enhancing uniformity of the display brightness of the AMOLED panel.

In the end, the process of driving the pixel circuit of the AMOLED display panel proposed by the embodiment of the present disclosure is complete.

The present disclosure also provides an active-matrix organic light-emitting diode (AMOLED) display panel comprising a plurality of pixel units and a driving circuit. The driving circuit includes a first thin-film transistor (TFT), a second TFT, a third TFT, a fourth TFT, a fifth TFT, a storage capacitor, and an organic light-emitting diode (OLED).

The first thin-film transistor (TFT) includes a source connected to a corresponding data line, a drain connected to a first reference node, and a gate inputting a first controlling signal. The storage capacitor includes a first terminal and a second terminal. The second terminal is grounded. The second TFT includes a source connected to the first reference node, a gate connected to a first terminal of the storage capacitor, and a drain connected to a second reference node. The third TFT includes a source connected to the second reference node, a gate inputting a third controlling signal, and a drain connected to a first terminal of the storage capacitor. The fourth TFT includes a source connected to the second reference node, a drain connected to a second driving voltage, and a gate connected to a fourth controlling signal. The fifth TFT includes a drain connected to the first reference node, and a gate inputting a fifth controlling signal. The OLED includes a positive electrode connected to a first driving voltage and a negative electrode connected to a source of the fifth TFT.

Preferably, a time period of driving the AMOLED display panel by using the driving circuit comprises an electric-potential-initialization stage, a charge-storage stage, and an illumination-display stage.

Preferably, when the driving circuit of the AMOLED display panel keeps at the electric-potential-initialization stage, the first TFT and the fifth TFT are turned off; the third TFT and the fourth TFT are turned on; the storage capacitor is charged through the third TFT and the fourth TFT; the OLED does not emit light.

Preferably, when the driving circuit of the AMOLED display panel keeps at the charge-storage stage, the fourth TFT and the fifth TFT are turned off; the first TFT and the third TFT are turned on; the storage capacitor is charged by the first TFT, the second TFT, and the third TFT through the data line; the OLED does not emit light.

Preferably, when the driving circuit of the AMOLED display panel keeps at the illumination-display stage, the first TFT and the third TFT are turned off; the fourth TFT and the fifth TFT are turned on; luminance of the OLED is controlled by the storage capacitor through the first TFT.

Preferably, voltage across the charged storage capacitor is Vdata−Vth, where Vdata indicates data signal voltage of the data line, and Vth indicates threshold voltage of the second TFT.

Owing to the arrangement of five TFTs and one storage capacitor for the driving circuit of the AMOLED display panel and the AMOLED display panel proposed by the present disclosure, the luminance of the OLED is not affected by the threshold voltage of the TFT, thereby enhancing uniformity of the display brightness of the AMOLED display panel. In this way, the AMOLED display panel with poorer uniformity of display brightness due to inconsistency of the threshold voltage of the TFT in the related art is well solved.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A driving circuit for an active-matrix organic light-emitting diode (AMOLED) display panel, comprising:

a first thin-film transistor (TFT), comprising a source connected to a corresponding data line, a drain connected to a first reference node, and a gate inputting a first controlling signal;

a storage capacitor, comprising a first terminal and a second terminal; the second terminal grounded;

a second TFT, comprising a source connected to the first reference node, a gate connected to a first terminal of the storage capacitor, and a drain connected to a second reference node;

a third TFT, comprising a source connected to the second reference node, a gate inputting a third controlling signal, and a drain connected to a first terminal of the storage capacitor;

a fourth TFT, comprising a source connected to the second reference node, a drain connected to a second driving voltage, and a gate connected to a fourth controlling signal;

a fifth TFT, comprising a drain connected to the first reference node, and a gate inputting a fifth controlling signal; and an organic light-emitting diode (OLED), comprising a positive electrode connected to a first driving voltage and a negative electrode connected to a source of the fifth TFT;

wherein a time period of driving the AMOLED display panel by using the driving circuit comprises an electric-potential-initialization stage, a charge-storage stage, and an illumination-display stage;

wherein when the driving circuit of the AMOLED display panel keeps at the electric-potential-initialization stage, the first TFT and the fifth TFT are turned off; the third TFT and the fourth TFT are turned on; the storage capacitor is charged through the third TFT and the fourth TFT; the OLED does not emit light;

wherein when the driving circuit of the AMOLED display panel keeps at the charge-storage stage, the fourth TFT and the fifth TFT are turned off; the first TFT and the third TFT are turned on; the storage capacitor is charged by the first TFT, the second TFT, and the third TFT through the data line; the OLED does not emit light;

wherein when the driving circuit of the AMOLED display panel keeps at the illumination-display stage, the first TFT and the third TFT are turned off; the fourth TFT and the fifth TFT are turned on; luminance of the OLED is controlled by the storage capacitor through the first TFT.

2. The driving circuit of claim 1, wherein voltage across the charged storage capacitor is Vdata−Vth, where Vdata indicates data signal voltage of the data line, and Vth indicates threshold voltage of the second TFT.

3. A driving circuit for an active-matrix organic light-emitting diode (AMOLED) display panel, comprising:

a first thin-film transistor (TFT), comprising a source connected to a corresponding data line, a drain connected to a first reference node, and a gate inputting a first controlling signal;

a storage capacitor, comprising a first terminal and a second terminal; the second terminal grounded;

a second TFT, comprising a source connected to the first reference node, a gate connected to a first terminal of the storage capacitor, and a drain connected to a second reference node;

a third TFT, comprising a source connected to the second reference node, a gate inputting a third controlling signal, and a drain connected to a first terminal of the storage capacitor;

a fourth TFT, comprising a source connected to the second reference node, a drain connected to a second driving voltage, and a gate connected to a fourth controlling signal;

a fifth TFT, comprising a drain connected to the first reference node, and a gate inputting a fifth controlling signal; and an organic light-emitting diode (OLED), comprising a positive electrode connected to a first driving voltage and a negative electrode connected to a source of the fifth TFT, wherein a time period of driving the AMOLED display panel by using the driving circuit comprises an electric-potential-initialization stage, a charge-storage stage, and an illumination-display stage, wherein when the driving circuit of the AMOLED display panel keeps at the electric-potential-initialization stage, the first TFT and the fifth TFT are turned off; the third TFT and the fourth TFT are turned on; the storage capacitor is charged through the third TFT and the fourth TFT; the OLED does not emit light.

4. The driving circuit of claim 3, wherein when the driving circuit of the AMOLED display panel keeps at the charge-storage stage, the fourth TFT and the fifth TFT are turned off; the first TFT and the third TFT are turned on; the storage capacitor is charged by the first TFT, the second TFT, and the third TFT through the data line; the OLED does not emit light.

5. The driving circuit of claim 4, wherein voltage across the charged storage capacitor is Vdata−Vth, where Vdata indicates data signal voltage of the data line, and Vth indicates threshold voltage of the second TFT.

6. The driving circuit of claim 3, wherein when the driving circuit of the AMOLED display panel keeps at the illumination-display stage, the first TFT and the third TFT are turned off; the fourth TFT and the fifth TFT are turned on; luminance of the OLED is controlled by the storage capacitor through the first TFT.

7. An active-matrix organic light-emitting diode (AMOLED) display panel comprising a plurality of pixel units and a driving circuit, the driving circuit comprising:

a first thin-film transistor (TFT), comprising a source connected to a corresponding data line, a drain connected to a first reference node, and a gate inputting a first controlling signal;

a storage capacitor, comprising a first terminal and a second terminal; the second terminal grounded;

a second TFT, comprising a source connected to the first reference node, a gate connected to a first terminal of the storage capacitor, and a drain connected to a second reference node;

a third TFT, comprising a source connected to the second reference node, a gate inputting a third controlling signal, and a drain connected to a first terminal of the storage capacitor;

a fourth TFT, comprising a source connected to the second reference node, a drain connected to a second driving voltage, and a gate connected to a fourth controlling signal;

a fifth TFT, comprising a drain connected to the first reference node, and a gate inputting a fifth controlling signal; and an organic light-emitting diode (OLED), comprising a positive electrode connected to a first driving voltage and a negative electrode connected to a source of the fifth TFT, wherein a time period of driving the AMOLED display panel by using the driving circuit comprises an electric-potential-initialization stage, a charge-storage stage, and an illumination-display stage, wherein when the driving circuit of the AMOLED display panel keeps at the electric-potential-initialization stage, the first TFT and the fifth TFT are turned off; the third TFT and the fourth TFT are turned on; the storage capacitor is charged through the third TFT and the fourth TFT, the OLED does not emit light.

8. The AMOLED display panel of claim 7, wherein when the driving circuit of the AMOLED display panel keeps at the charge-storage stage, the fourth TFT and the fifth TFT are turned off; the first TFT and the third TFT are turned on; the storage capacitor is charged by the first TFT, the second TFT, and the third TFT through the data line; the OLED does not emit light.

9. The AMOLED display panel of claim 8, wherein voltage across the charged storage capacitor is Vdata−Vth, where Vdata indicates data signal voltage of the data line, and Vth indicates threshold voltage of the second TFT.

10. The AMOLED display panel of claim 7, wherein when the driving circuit of the AMOLED display panel keeps at the illumination-display stage, the first TFT and the third TFT are turned off; the fourth TFT and the fifth TFT are turned on; luminance of the OLED is controlled by the storage capacitor through the first TFT.

* * * * *